United States Patent [19]

Littwin

[11] 4,208,656

[45] Jun. 17, 1980

[54] BATTERY LIFT MAGNET CONTROL

[76] Inventor: Arthur K. Littwin, 6555 N. LeMai, Lincolnwood, Ill. 60646

[21] Appl. No.: 914,744

[22] Filed: Jun. 12, 1978

[51] Int. Cl.[2] ..... G08B 21/00

[52] U.S. Cl. ..... 340/635; 340/664; 340/685

[58] Field of Search ..... 340/635, 636, 661, 680, 340/685, 647, 650, 652, 653, 664; 324/29.5; 320/48, 40; 361/143, 144, 139

[56] References Cited

U.S. PATENT DOCUMENTS

| | | | |
|---|---|---|---|
| 3,593,099 | 7/1971 | Scholl | 320/48 |
| 3,786,342 | 1/1974 | Molyneux | 340/635 |
| 3,997,888 | 12/1976 | Kremer | 340/636 |
| 4,021,718 | 5/1977 | Konrad | 340/636 |

*Primary Examiner*—Bernard Konick
*Assistant Examiner*—Joseph A. Popek
*Attorney, Agent, or Firm*—Paul H. Gallagher

[57] ABSTRACT

A lift magnet for a lift truck, crane, etc., energized by a battery, and a transformer and rectifier are provided for charging the battery from an AC source; a transistorized circuit is included; a SAFE signal light is provided and controlled by a first transistor in services therewith; the transistor is normally conducting and when a failure occurs the transistor becomes non-conducting and the SAFE signal light de-energized; the failure may be from low voltage condition of the battery, or such defects as a break in the circuit or switch means, such as would prevent proper operation despite full voltage; also, before the electromagnet is fully energized, and the current therefore is low, an UNSAFE signal light indicates such low current condition; a second transistor is provided in series with the UNSAFE signal light, this second transistor being normally held in non-conducting condition by the first transistor; when an UNSAFE condition results the first transistor de-energizes the SAFE signal light and in the same operational step renders the second transistor conducting which thereby energizes the UNSAFE light; a zener diode is incorporated in conjunction with the transistorized circuit for providing a stabilized voltage therefor.

9 Claims, 3 Drawing Figures

6.2 VDC
MAGNET
610 CP
GREEN
RED

OFF
-CHG
+MAG
ON
CHARGE
SWITCH
A.C. LINE
RECEP.
MAGNET
CHARGE
GRN
RED
GRN
RED

BATTERY LIFT MAGNET CONTROL

FIELD OF THE INVENTION

The invention resides in the field of lift trucks or cranes having an electromagnet for lifting a load and carrying or transporting it. The electromagnet is energized by a battery and the battery is recharged during periods of non-use of the machine such as overnight. The present invention has to do with means for energizing and controlling the magnet, and indicating its present operable condition.

OBJECTS OF THE INVENTION

An object of the invention is to provide a control for an electromagnet, utilized as a lift magnet, which is responsive to an electric current below a predetermined value, independent of the condition of saturation of the lift magnet, whereby the condition of the current can be sensed, and a signal given whether before the lift magnet is brought up to complete saturation, and thereafter, in a condition in which the current is reduced by some defect other than the condition of the control battery.

A still further object is to provide a control of the foregoing character which utilizes a novel transistorized arrangement for producing the control functions, and control indications, in a quick and unusually responsive manner.

Still another object is to provide an arrangement of the character just referred to, utilizing transistorized control, in which a zener diode is utilized for stabilizing the voltage used in the transistorized control, that voltage being provided by the main electric circuit that includes the lift magnet.

A further object is to provide apparatus of the foregoing general character having the novel feature that the sensing, for safety purposes, is done through both voltage differential and current, whereby a low voltage condition of the battery can be sensed, and also even though the battery itself may be in fully charged condition, other defects may occur, such as defects in the circuit in which the battery is incorporated, or mechanical switching, which reduce the current flowing, the control means senses the lower-value current and produces a desired warning indication.

A DESCRIPTION OF A PREFERRED EMBODIMENT

Figures 1, 2, 3:
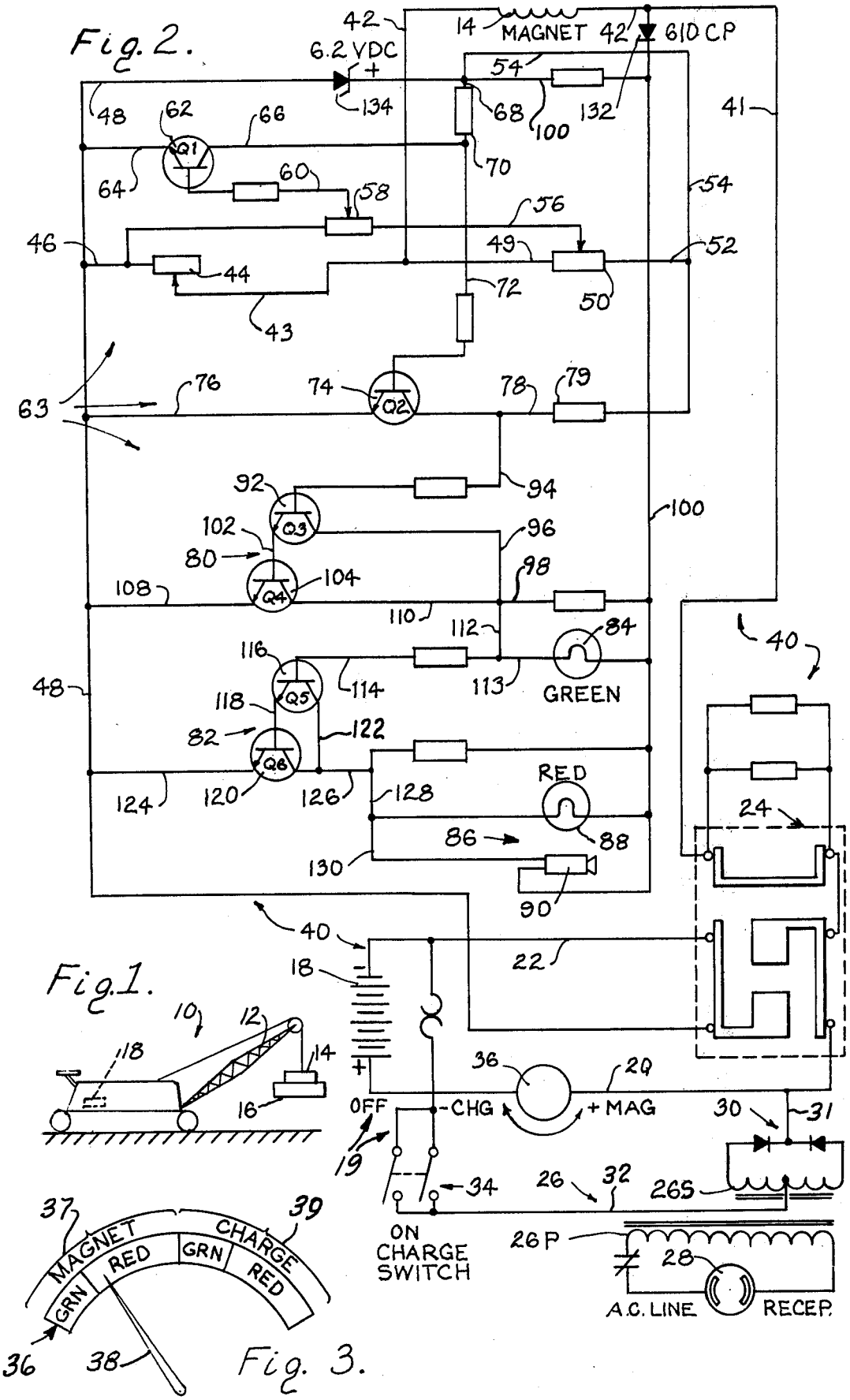
FIG. 1 is a semi-diagrammatic view of a crane of a type suitable for embodying the present invention.
FIG. 2 is a diagram of the electrical circuit utilized in the control of the lift magnet of FIG. 1.
FIG. 3 is a semi-diagrammatic view of certain elements of a charge meter.

Referring in detail to the drawings, FIG. 1 shows a lift truck or crane 10 of suitable kind having a derrick 12 carrying an electromagnet 14 usually called a lift magnet or magnet. The lift magnet 14 upon being energized is capable of lifting a load 16 for carrying it to another location. The magnet 14 is energized by a battery 18. In the circuit of FIG. 2, the magnet 14 is shown at the top, and the battery 18 at lower left.

The circuit of FIG. 2 includes what may be referred to, for convenience, as a sub-circuit 19, including conductors 20 and 22 leading from the battery 18 to a main switch means indicated in its entirety at 24. A transformer 26 is provided having a primary 26P and a secondary 26S, the transformer having a suitable connector 28 adapted for connection with an AC source. Rectifier means 30 is provided, having a conductor 31 leading from the secondary 26S to the conductor 20, and another conductor 32 leads from the secondary 26S through a charge switch 34 to the conductor 22. For purposes of charging the battery 18 such as overnight, the connector 28 is plugged in an AC source and the charge switch 34 closed, in ON position. After the battery is charged the connector 28 is disconnected, the switch 34 opened, and the battery is utilized for controlling the lift magnet 14. A meter 36 is interposed in the conductor 20, this meter being shown also in FIG. 3. It includes a first range 37 with GREEN and RED portions for indicating, by a pointer 38, the condition of charging the battery, and a second range 39, also with GREEN and RED portions, for indicating the condition of the battery with relation to the magnet 14. This latter feature will be referred to hereinbelow in the operation of the apparatus.

Upon disconnection of the connector 28, and thus the transformer, and the utilization of the battery for controlling the magnet, a circuit is set up through a main circuit 40: the positive conductor 20, through the switch 24, a conductor 41; leading from the conductor 41 is a conductor 42 which directly includes the magnet 14, and this conductor leads to another conductor 43 which continues through a potentiometer 44, from which it leads to another conductor 46, and the latter is connected to a conductor 48; the conductor 48 continues through the main switch 24 and through the negative conductor 22 to the battery 18.

The potentiometer 44 is of particular significance in the control functions on the magnet as described more fully hereinbelow. The conductor 42 leading from the magnet also leads to a conductor 49 which leads to another potentiometer 50 from which another conductor 52 continues and connects with a conductor 54.

Another conductor 56 connects both potentiometers 50 and 44 and includes a trimmer potentiometer 58, from which leads a conductor 60 to the base of a transistor 62 which is incorporated in a transistorized sub-circuit or electronic sub-circuit identified generally at 63. A conductor 64 interconnects the emitter of this transistor 62 with the conductor 48, and another conductor 66 leads from the collector of the transistor to a conductor 68 which in turn connects with the conductor 54. The conductor 68 includes a resistor 70.

Leading from the conductor 68 is another conductor 72 to the base of another transistor 74, the emitter of which is connected by a conductor 76 to the conductor 48; leading from the collector of the transistor 74 is another conductor 78 in which is a resistor 79 and which leads to the conductor 52. The transistorized sub-circuit 63 also includes two Darlington units or circuits 80 and 82, the former being connected in series with, and controlling, a signal indicating SAFE light 84 (green), and the latter unit 82 being connected in series with and controlling signal indicating UNSAFE signal means 86, this latter signal means including a light 88 (red) and a buzzer 90 arranged in parallel and adapted for actuation simultaneously.

The first Darlington unit 80 includes a first transistor 92 from the base of which a conductor 94 leads to the conductor 78 and from the collector of which a conductor 96 leads to a conductor 98 which in turn connects with a conductor 100; the emitter of the transistor 92 is connected through a conductor 102 to the base of a second transistor 104, and leading from the emitter of the transistor 104, is a conductor 108 leading to the conductor 48; leading from the collector of the transistor 104 is another conductor 110 connected with the conductor 98.

Leading from the conductor 98, 110 is another conductor 112 in turn connected with a conductor 114 leading to the base of a first transistor 116 of the second Darlington unit 82. A conductor 118 leads from the emitter of the transistor 116 to the base of the transistor 120, which constitutes the second transistor of the Darlington unit 82, and a further conductor 122 interconnects the collectors of these two transistors. A conductor 124 leads from the emitter of the transistor 120 to the conductor 48 and an additional conductor 126 leads from the conductor 122 and from the collector of the transistor 120 to a conductor 128 which contains the UNSAFE light 88 and another conductor 130 which includes the buzzer 90. The conductors 128 and 130 are in parallel and are both connected with the conductor 100.

The conductor 100 leads to the conductor 41 and includes a rectifier 132. The conductor 48 near the top of the figure leads to the right and includes a zener diode 134 and this conductor is connected with the conductors 68, 54 and 100.

PRACTICAL OPERATION, AND FUNCTIONING

In the operation of the device, an initial step is to connect the connector 28 with an AC source, and close the switch 34, to charge the battery 18, if the battery is not then in fully charged condition. Upon the battery being charged, the connector 28 is of course disconnected and the electromagnet, or lift magnet, 14 is operated and controlled by the battery, in the use of the machine 10 in a known manner. It will be understood, of course, that in the charging operation the main switch 24 is open, and in the use of the machine that switch is closed. The closure of this switch energizes the main circuit 40, including the conductors 20, 41, 42, 43, 46, 48, and including the lift magnet 14.

In the operation of the apparatus as described hereinbelow, and particularly the operation of the transistorized sub-circuit 63, the zener diode 134 provides a stabilized DC source for the transistorized circuit so that when the current drain from the battery causes the battery voltage to fall, the voltage across the zener will remain relatively stable. Accordingly this zener is used as a reference supply for the transistorized circuit.

With the main circuit closed as referred to above, and in normal operation, the transistor 62 is made conducting: through the conductors 41, 42, 43, 56, 60, 64, 48. This conducting condition of the transistor is under the control of the combined voltage of the potentiometers 44, 50 and the trimmer potentiometer 58, and this transistor thereby holds the transistor 74 OFF, non-conducting, and thereby the transistors 92, 104 are ON.

This control is provided by the voltage drop across the resistor 44, in the main circuit, producing a bias for turning on the transistor 62 and this transistor provides a current through the resistor 70. A voltage drop across the resistor 70 is utilized as a voltage supply for turning on the transistor 74. The transistor 74 then causes a voltage drop to appear across the resistor 79, and this voltage drop provides a supply voltage for turning on the transistor 92. This transistor is arranged in the Darlington circuit 80 as noted, having its base connected with the conductor 78 and the collector of the transistor 74, and the emitter of the transistor 92 is connected to the base of the transistor 104. With the transistor 74 fully conducting there is a minimum voltage drop across the emitter/collector of that transistor rendering it non-conducting. However, in the normal operation as stated above, the transistors 92, 104 in the Darlington circuit are conducting, and this energizes the SAFE signal light 84 which is in series with those transistors.

The signal light 84 is also in series with the Darlington circuit 82 and when that light is ON, the transistors 116, 120 of the Darlington circuit 82 are non-conducting and the UNSAFE signal light 88 is held OFF.

When the battery voltage falls below a safe level, the transistor 62 becomes non-conducting and this enables the transistor 74 to become conducting, and the transistors 92, 104 then become non-conducting and the signal light 84 is extinguished.

At this step the transistors 116, 120 become conducting and the circuit is established through the UNSAFE signal light 88 and the buzzer 90, actuating them.

A great advantage of the arrangement is that the signal lights 84, 88 are triggered on and off, as distinguished from a slow or gradual turning on or off. This triggering effect is under the immediate control of the trimmer potentiometer 58.

A further important advantage is that the signal means will be energized, or de-energized, by defects in the circuit besides mere voltage drop in the battery. For example, if a defect should occur in the switch 24, or in the electromagnet 14, or in any of various other points, the current flow will drop or cease, and this change initiates the actuation of the signal means. This is particularly important for example in the case where a load is being held at the moment by the electromagnet and a defect occurs somewhere in the circuit. Even though such a defect may occur, the electromagnet continues to be effective for holding the load, and the operator would not know, from any appearance of the operation of the electromagnet in holding a load, that any defect occurred, but such defect is announced by the signal means in the manner referred to.

Another source of mistake may be the temporary or accidental inability of the operator to observe the meter 36. In such a case and when such a defect occurs, the condition of the signal lights 84, 88 will apprise him of the condition, i.e., the light 84 will be OFF and the light 88 ON. Additionally, if that visual condition should not catch his eye, the buzzer 90 will be sounded along with the light 88 being ON.

An additional advantage of the arrangement has to do with the fact that, due to the inherent characteristics of an electromagnet, the current flow therethrough does not reach its peak until the electromagnet is fully saturated. When the apparatus is first turned on, and before the electromagnet becomes fully saturated, the current flow is low and the UNSAFE signal light 88 is ON and the SAFE signal light 84 is OFF, due to the low rate of flow of the current. The operator appreciates that this is not a defect, but merely an indication of the condition of the electromagnet and that no effort should be made at that time to lift a load. However, when the electromagnet becomes fully saturated, or sufficiently saturated, the transistor 62 is triggered as described above and the SAFE signal light 84 is turned ON and the UNSAFE signal light 88 is turned OFF. It will be understood in this case also that the buzzer 90 is actuated along with the signal light 88.

Summarizing advantages, the apparatus is operable for detecting voltage conditions, and current conditions, that is, in one case when the voltage level of the battery reaches a predetermined low level, the current is correspondingly low and the appropriate signals are produced; in the other case where a defect occurs as explained above, the low current, or absense of current, causes the signals to be produced as described.

I claim:

1. Electrical controlling and signalling apparatus comprising, an electrical circuit, a battery in the circuit, an electromagnet in the circuit in series with the battery and adapted to be charged by the battery and when charged operable for magnetically holding a load, signal means in the circuit and including a SAFE indicator and an UNSAFE indicator, those indicators being in mutual parallel relationship but together in series with the battery and electromagnet, and control means in the circuit, in series with the battery, electromagnet and signal means, operable in response to current in the circuit, for energizing the UNSAFE indicator when the electromagnet is not charged and energizing the SAFE indicator when the electromagnet is charged.

2. Apparatus according to claim 1 wherein, said control means is operable for de-energizing the SAFE indicator and energizing the UNSAFE indicator in response to a defect occurring in the circuit notwithstanding a charged condition of the electromagnet.

3. Apparatus according to claim 1 wherein, due to the inherent characteristics of the electromagnet, current flow therethrough does not reach its peak until the electromagnet reaches its full-charged condition, and the control means is operable for energizing the UNSAFE indicator and de-energizing the SAFE indicator when the current flow is less than at its peak, and when it does reach its peak, the control means is operable for de-energizing the UNSAFE indicator and energizing the SAFE indicator.

4. Apparatus according to claim 1 wherein, the UNSAFE indicator includes visual and audio components.

5. Apparatus according to claim 1 wherein, the circuit includes a first, a second, a third, and a fourth transistor, the circuit includes a transistorized sub-circuit, the transistorized sub-circuit includes the first transistor in series with the electromagnet, the third transistor is in series with the SAFE indicator, the fourth transistor is in series with the UNSAFE indicator, the circuit being operable for turning ON the first transistor in response to the current reaching its full peak and the electromagnet being charged, the first transistor being operable, when turned ON, for turning ON the third transistor and thereby energizing the SAFE indicator.

6. Apparatus according to claim 5 wherein, the SAFE indicator, when energized, is operable for turning OFF the third transistor and thereby disabling the UNSAFE indicator, and when de-energized enabling the third transistor to turn ON and enabling the UNSAFE indicator to be energized.

7. Apparatus according to claim 5 wherein, the circuit includes the second transistor across the electromagnet, and the second transistor being operable, in response to control by the first transistor, for controlling the third transistor.

8. Apparatus according to claim 5 wherein, the circuit includes a zener diode across the first transistor operable for providing stable voltage to the transistor upon decrease of current in the electromagnet.

9. Apparatus according to claim 5 wherein, the circuit includes adjustable resistance in series with the first transistor operable for producing abrupt ON-OFF action of that transistor.

* * * * *